US007144318B2

(12) United States Patent
Wei

(10) Patent No.: US 7,144,318 B2
(45) Date of Patent: Dec. 5, 2006

(54) CARRYING DISK DEVICE OF COIN DISPENSER

(75) Inventor: Ming-Shan Wei, Kaohsiung (TW)

(73) Assignee: Paokai Electronic Enterprise Co., Ltd., Kaohsiung (TW)

( * ) Notice: Subject to any disclaimer, the term of this patent is extended or adjusted under 35 U.S.C. 154(b) by 101 days.

(21) Appl. No.: 10/920,295

(22) Filed: Aug. 18, 2004

(65) Prior Publication Data

US 2006/0040604 A1 Feb. 23, 2006

(51) Int. Cl.
*G07D 1/00* (2006.01)

(52) U.S. Cl. ..... 453/57; 453/18

(58) Field of Classification Search ..... 453/18, 453/29, 34, 49, 57; 221/200, 204, 205; 366/111, 366/112, 114, 239

See application file for complete search history.

(56) References Cited

U.S. PATENT DOCUMENTS 2,848,003 A * 8/1958 Gross ..... 453/20
4,615,350 A * 10/1986 Boudville ..... 453/57
4,881,919 A * 11/1989 Dabrowski ..... 453/57
4,913,315 A * 4/1990 Wagner ..... 221/200
5,098,340 A * 3/1992 Abe ..... 453/57
5,326,312 A * 7/1994 Patroni ..... 453/57
5,695,395 A * 12/1997 Ota et al. ..... 453/57
6,080,057 A * 6/2000 Bell et al. ..... 453/57
6,220,954 B1 * 4/2001 Nguyen et al. ..... 453/57
6,350,193 B1 * 2/2002 Paulsen ..... 453/57

FOREIGN PATENT DOCUMENTS

EP 1 020 818 A1 7/1999

* cited by examiner

*Primary Examiner*—Patrick Mackey
*Assistant Examiner*—Mark J. Beauchaine
(74) *Attorney, Agent, or Firm*—Troxell Law Office, PLLC

(57) ABSTRACT

A carrying disk device of coin dispenser mainly includes a machine frame, a carrying disk and a guide arm. The carrying disk and the guide arm are connected to the machine frame. The carrying disk has a plurality of posts arranged in a plurality of radial rows on the coin-carrying surface thereof. The posts are fixed on and protrude from the coin-carrying surface. A plurality of coin-holding spaces are formed between the plurality rows of the posts. The guide arm covers a portion of the coin-carrying surface of the carrying disk, and has a guide lateral and a plurality of curvilinear grooves on the bottom thereof. The curvilinear grooves extend to the guide lateral of the guide arm to allow the posts to pass under the guide arm when the carrying disk rotates.

2 Claims, 5 Drawing Sheets

CARRYING DISK DEVICE OF COIN DISPENSER

FIELD OF THE INVENTION

The present invention relates to a coin dispenser, more particularly to a carrying disk device of coin dispenser without coin jam.

BACKGROUND OF THE INVENTION

Usually the game machines are mostly played via coins. Customers have to exchange bill for coin for playing game at a counter, resulting in manpower wasting. Therefore, an automatic coin dispenser is designed to automatically dispense and count the coins one by one. Presently a coin-dispensing machine utilizing a carrying disk to dispense coins is disclosed in EP Patent No. 1,020,818 entitled "coin returning device for coin actuated machines". A carrying disk is disposed on a machine frame, a coin-collecting hopper is disposed in the front of the carrying disk for collecting and storing the coins before dispensing coins. Also a guide arm and a coin-extraction trip are connected to the machine frame near to the outlet. A plurality of radical retractable pallets are installed in the carrying disk. When the carrying disk rotates, the coins may fall into the place between two adjacent retractable pallets on the carrying disk and are driven to move one by one. When one of the retractable pallets reaches the guide arm, the front elastic trapdoor will be pressed down by the guide arm and then to hide inside the carrying disk. At the same time, the back elastic trapdoor will push the coin to move away from the carrying disk, and the coin is guided by the guide arm and ejected by the coin-extraction trip from coin outlet. The retractable pallets easily cause elastic fatigue and incompliant retraction after a long time of the rotary operation, resulting in the problems of unable to push the coin or coin jam, even more seriously the whole carrying disk and power unit will be broken.

SUMMARY

The primary object of the present invention is to provide a carrying disk device of coin dispenser, which mainly includes a machine frame, a carrying disk and a guide arm. The carrying disk and the guide arm are connected to the machine frame. The carrying disk has a plurality of posts fixed on and protruding from its coin-carrying surface. The guide arm has a guide lateral and a plurality of curvilinear grooves on the bottom thereof. The curvilinear grooves extend to the guide lateral of the guide arm to allow the posts to pass under the guide arm without elastic movement as the carrying disk rotates. The conventionally retractable pallets on the carrying disk can be displaced with the posts so as to push the coin surely and lessen the occurring risk of coin jam.

A carrying disk device of coin dispenser in accordance with the present invention includes a machine frame, a carrying disk and a guide arm. The machine frame has an outlet. The carrying disk is rotatively connected with the machine frame. The carrying disk has a coin-carrying surface and a plurality of posts arranged in a plurality of radial rows. The posts are fixed on and protrude from the coin-carrying surface. A plurality of coin-holding spaces are formed between the plurality rows of the posts. The guide arm is connected with the machine frame to be adjacent to the outlet and cover a portion of the coin-carrying surface. Preferably, the area of the covered portion by the guide arm is larger than at least one of the coin-holding spaces. The guide arm has a guide lateral and a plurality of curvilinear grooves at the bottom thereof. The curvilinear grooves extend to the guide lateral to allow the posts to pass under the guide arm during rotating the carrying disk.

DETAILED DESCRIPTION OF THE PRESENT INVENTION

Figure 1:
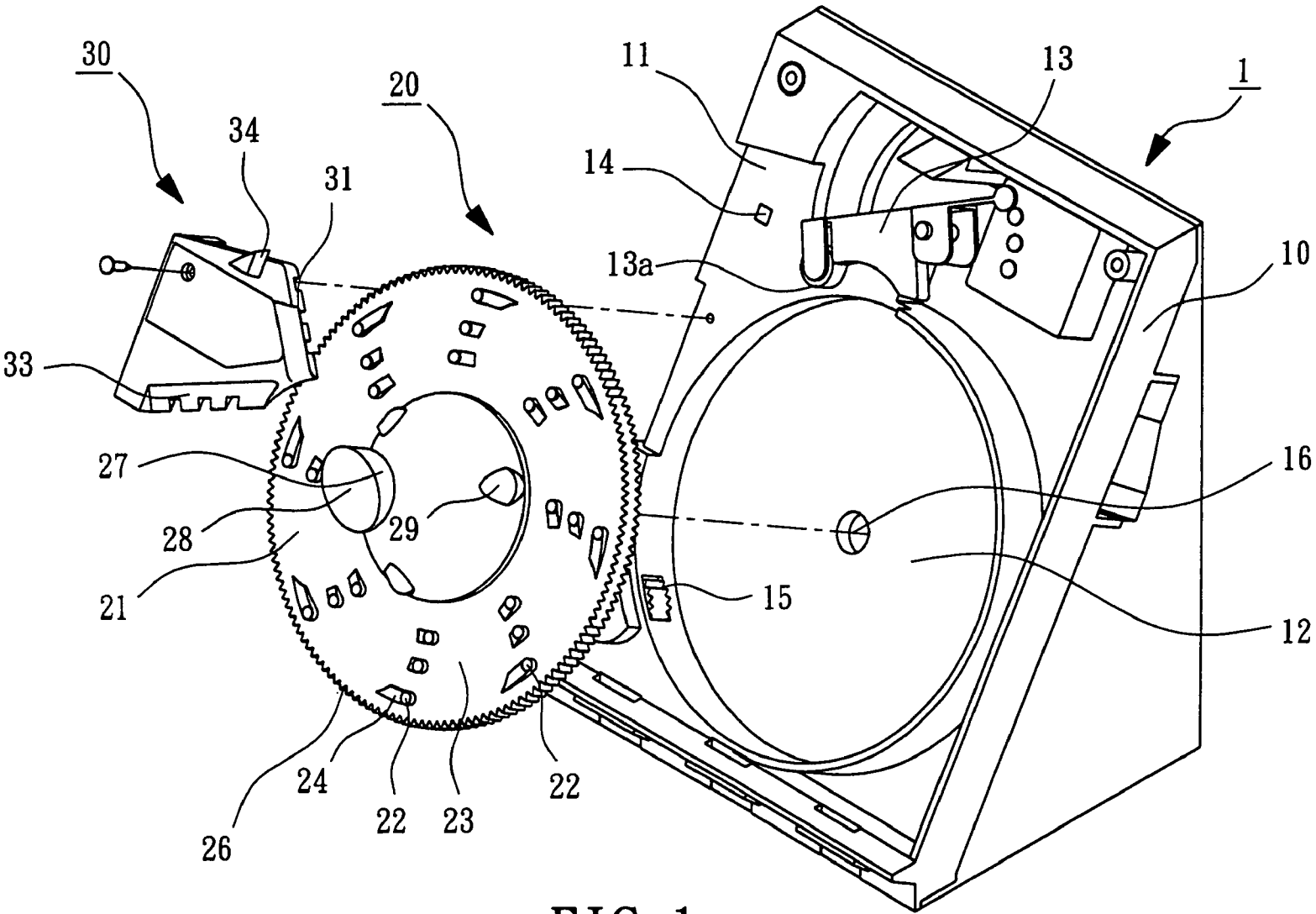
FIG. 1 is a perspective view of elements of the carrying disk device of coin dispenser in accordance with the present invention.

Referring to the drawings attached, the present invention will be described by means of the embodiment(s) below.

Figure 2:
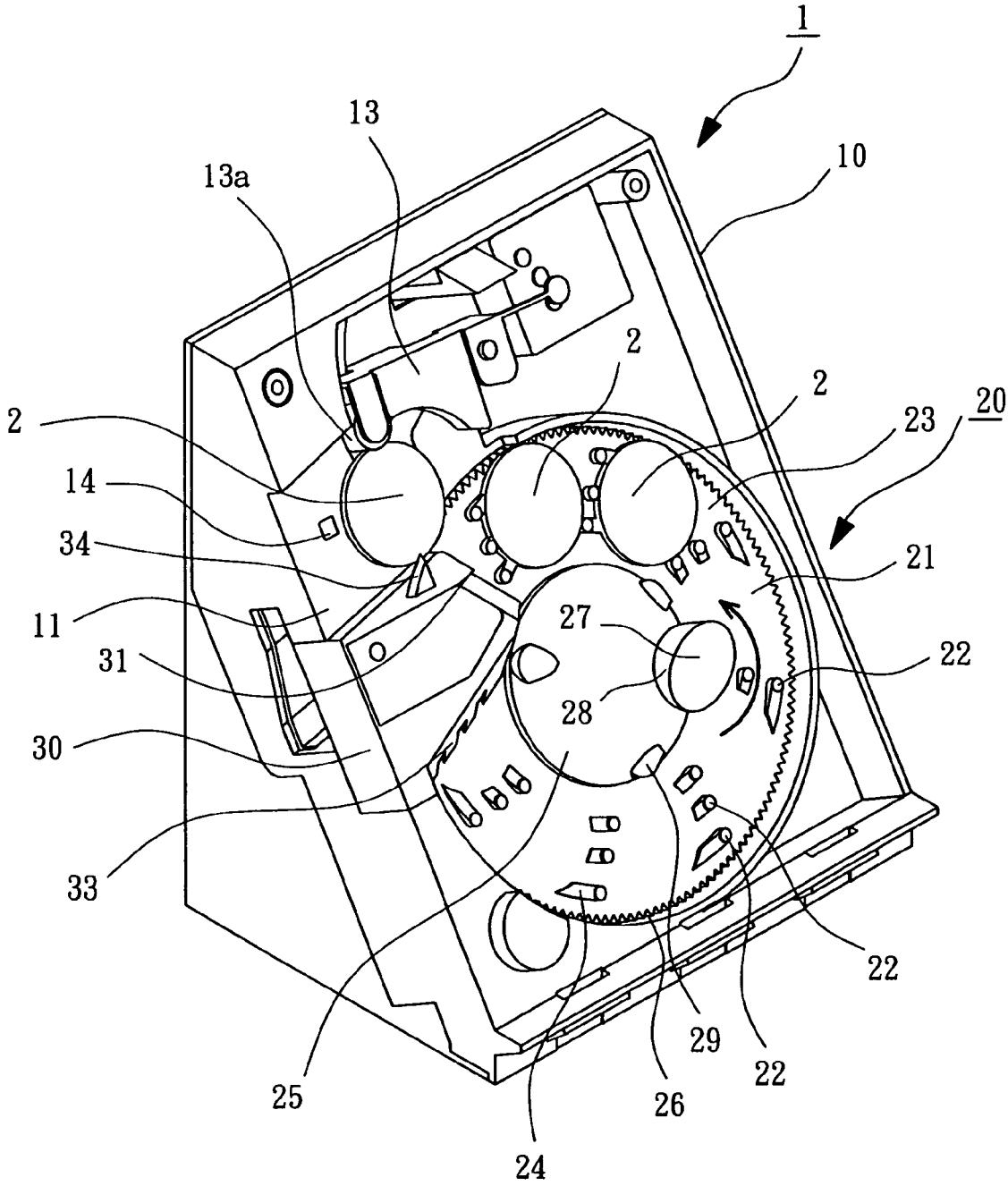
FIG. 2 is a perspective view of the carrying disk device of coin dispenser in accordance with the present invention.
Figure 3:
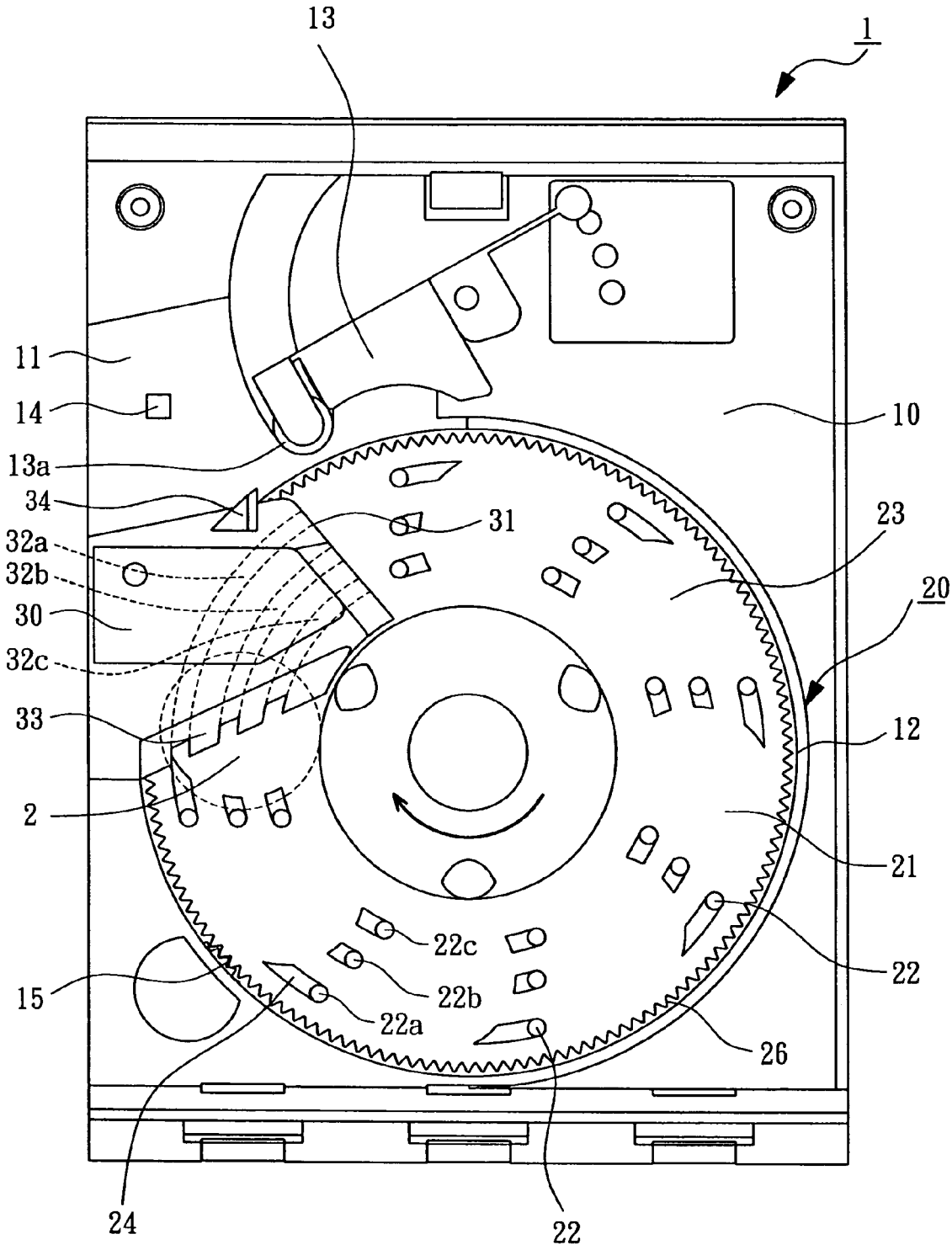
FIG. 3 is a top view of the carrying disk device of coin dispenser in accordance with the present invention.

According to an embodiment of the present invention, a carrying disk device of coin dispenser 1 is shown in FIGS. 1, 2, and 3. The carrying disk device 1 is applied for automatically dispensing coins 2, which mainly comprises a machine frame 10, a carrying disk 20 and a guide arm 30. The machine frame 10 has an outlet 11 and a disk-accommodating cavity 12. Besides, a power unit (not showed in the drawings) enables to drive the carrying disk 20. A coin-extraction trip 13 is connected with the machine frame 10 for ejecting coins 2. At least a sensor 14 is also installed inside the machine frame 10 to detect if coins 2 are ejected from the outlet 11. The power unit includes a motor gear 15 partially exposed out of the disc-accommodating cavity 12.

Referring to FIGS. 1, 2, and 3, the carrying disk 20 is connected with the machine frame 10 inside the disc-accommodating cavity 12, the carrying disk 20 has an axle shaft pivotally connected with the axle hole 16 of the machine frame 10. The carrying disk 20 has multiple gear teeth 26 at its lateral which is engaged with the motor gear 15 driven by motor to rotate the carrying disk 20. The carrying disk 20 has a coin-carrying surface 21 and a plurality of posts 22 arranged in a plurality of radial rows, the posts 22 are fixed on and protrude from the coin-carrying surface 21. Each radial row includes at least a post 22. In this embodiment, referring to FIG. 3, each radial row of the posts 22 includes three posts 22*a*, 22*b*, 22*c* that have different distance to the axle of the carrying disk 20. A plurality of coin-holding spaces 23 are formed between the plurality rows of the posts 22 on the coin-carrying surface 21 to flatly place a coin 2 (showed in FIG. 2). Generally the posts 22 have a diameter not more than 5.0 mm, preferably not more than 3.0 mm. In detailed, the diameter of the posts 22 should be smaller than one third of the diameter of one coin 2 or one third of the length of the guide lateral 31 of the guide arm 30. The spacing between the posts 22 arranged in each radial row (22*a*–22*b*, 22*b*–22*c*) is larger than the diameter of the posts 22*a*, 22*b*, 22*c* (>3.0 mm). Preferably, the spacing (22*a*–22*b*, 22*b*–22*c*) between the posts 22 is equal. In this embodiment, the carrying disk 20 further has a plurality of coin-sliding trails 24 formed on the coin-carrying surface 21 and contacting the posts 22 in a direction to make a side of the posts 22 cannot push the coins 2. The rotating direction of the carrying disk 20 of the present invention is not limited in the description of this embodiment. As showed in FIG. 2, when the carrying disk 20 rotates in the anti-clockwise direction, the coins 2 in the coin-holding spaces 23 will be flatly placed on the coin-carrying surface 21 one by one and pushed toward the outlet 11 by the posts 22 for coin-carrying. Referring to FIG. 3, when the carrying disk is rotated in the clockwise direction, the coins 2 placed in the coin-holding spaces 23 are unable to be pushed by the posts 22 due to the coin-sliding trails 24 at the other side of the posts 22. The coin-sliding trails 24 have an oblique surface to fall down the coins 2 for coin-agitating, may further prevent the carrying disk 20 from coin jam by means of coin-agitating and coin-carrying motions. Preferably, the carrying disk 20 has a cone 25 at its axle and a plurality of stirring rods 29 formed at the perimeter of the cone 25. In this embodiment, each stirring rod 29 has a sharp end to simultaneously agitate and turn the coins 2 while rotating the carrying disk 20. Furthermore, a coin-agitating controller 27 having an inclined surface 28 is disposed at the top of the cone 25 of the carrying disk 20.

Figure 4:
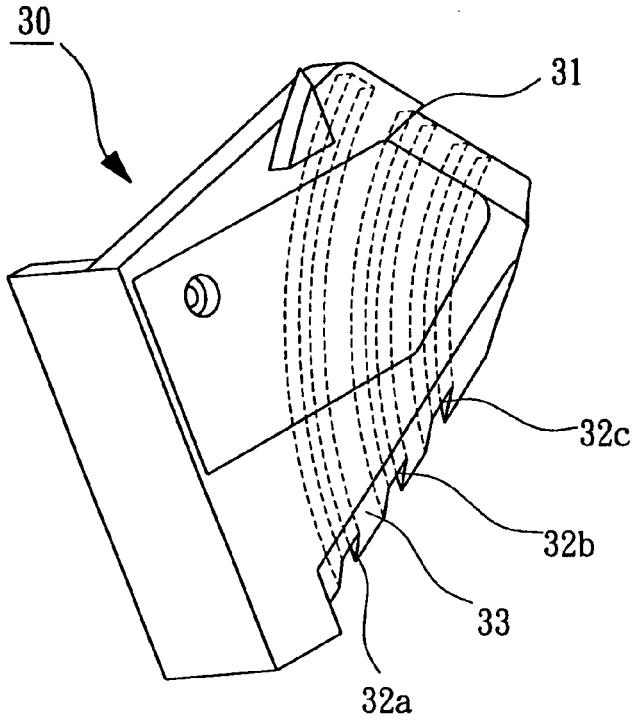
FIG. 4 is a perspective view of the guide arm of the carrying disk device of coin dispenser in accordance with the present invention.
Figure 5:
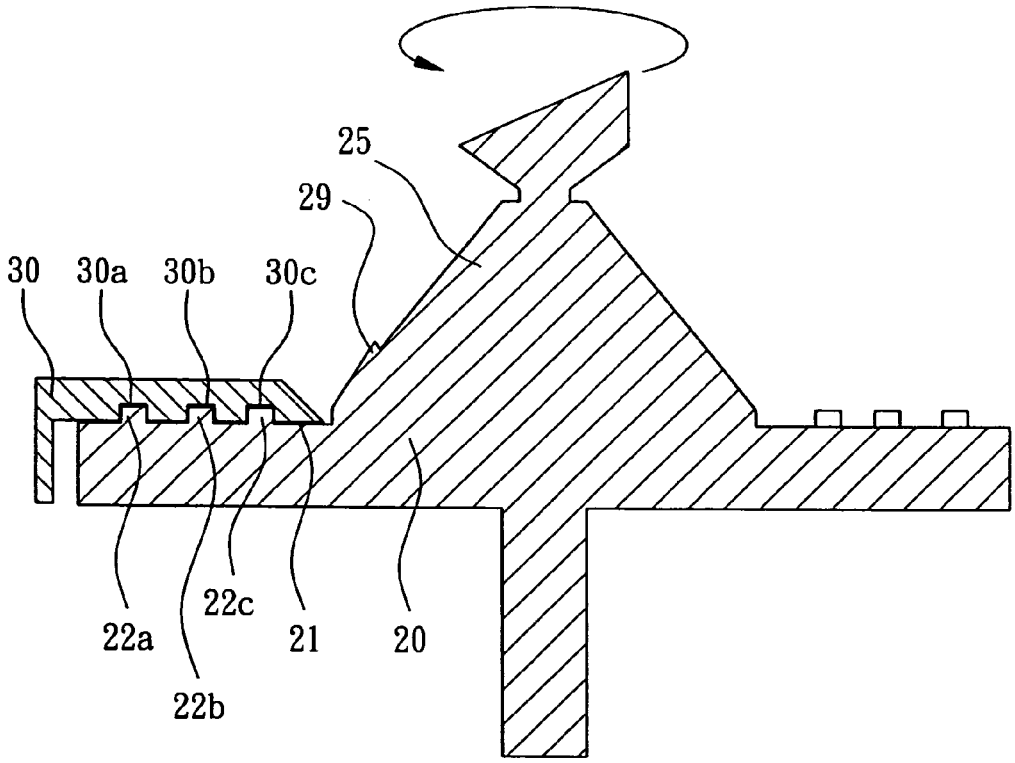
FIG. 5 is a cross-sectional view of the carrying disk device of coin dispenser under rotating condition in accordance with the present invention.

Referring to FIGS. 2 and 3, the guide arm 30 is connected with the machine frame 10. The guide arm 30 is adjacent to the outlet 11 and covers a portion of the coin-carrying surface 21 of the carrying disk 20. The covered area of the coin-carrying surface 21 by the guide arm 30 should be larger than at least one of the coin-holding spaces 23. Referring to FIG. 4, the guide arm 30 has a guide lateral 31 and a plurality of curvilinear grooves 32*a*, 32*b*, 32*c* at the bottom thereof. The quantity of the curvilinear grooves 32*a*, 32*b*, 32*c* is exactly equal to that of that of the posts 22 in one radial row. The curvilinear grooves 32*a*, 32*b*, 32*c* extend to the guide lateral 31. Desirably, the curvilinear grooves 32*a*, 32*b*, 32*c* are arcs of circles concentric with the axle of the carrying disk. The roller 13*a* of the coin-extraction trip 13 corresponds to one end of the guide lateral 31 of the guide arm 30 far away the axle of the carrying disk 20. Referring to FIG. 4, the posts 22 can pass the guide arm 30 row by row while the carrying disk 20 is rotated. However, referring to FIG. 2, since the coin 2 flatly placed in each coin-holding space 23 can not pass the guide lateral 31 of the guide arm 30, the coin 2 will be mechanically pushed by the posts 22 in a back row along the guide lateral 31 of the guide arm 30 to slide upwardly to the outlet 11. When the coin 2 contacts the roller 13*a* of the coin-extraction trip 13 and slides through the guide lateral 31, the coin-extraction trip 13 will eject the coin 2 from the outlet 11 and then the sensor 14 detects the coin 2 for counting. In this embodiment, the guide arm 30 further has a coin-sliding inclined lateral 33 and a limiting tip 34. The curvilinear grooves 32*a*, 32*b*, 32*c* extend to the coin-sliding inclined lateral 33 and the guide lateral 31. The limiting tip 34 is formed at the far end of the guide lateral 31 adjacent to the outlet 11 so as to prevent the coins 2 from turning and falling. Referring to FIG. 3, when the carrying disk 20 rotates in the clockwise direction, the coin-sliding inclined lateral 33 and the coin-sliding trails 24 at the other side of the posts 22 may help guiding the coins 2 to slide out of the coin-holding space 23, thereby further prevents the carrying disk 20 from coin jam by means of coin-agitating and coin-turning motions.

Accordingly, in the foregoing carrying disk device of coin dispenser 1, the posts 22 are immovably fixed on the carrying disk 20 to displace conventionally retractable pallets, which are arranged in a plurality of radial rows. The curvilinear grooves 32*a*, 32*b*, 32*c* are formed under the guide arm 30 allow the posts 22 to pass except for the coins 2. Therefore the carrying disk 20 moves more smoothly to dispensing coins 2 and the possibility of breaking the carrying disk 20 by coin jam is decreased.

Figure 6:
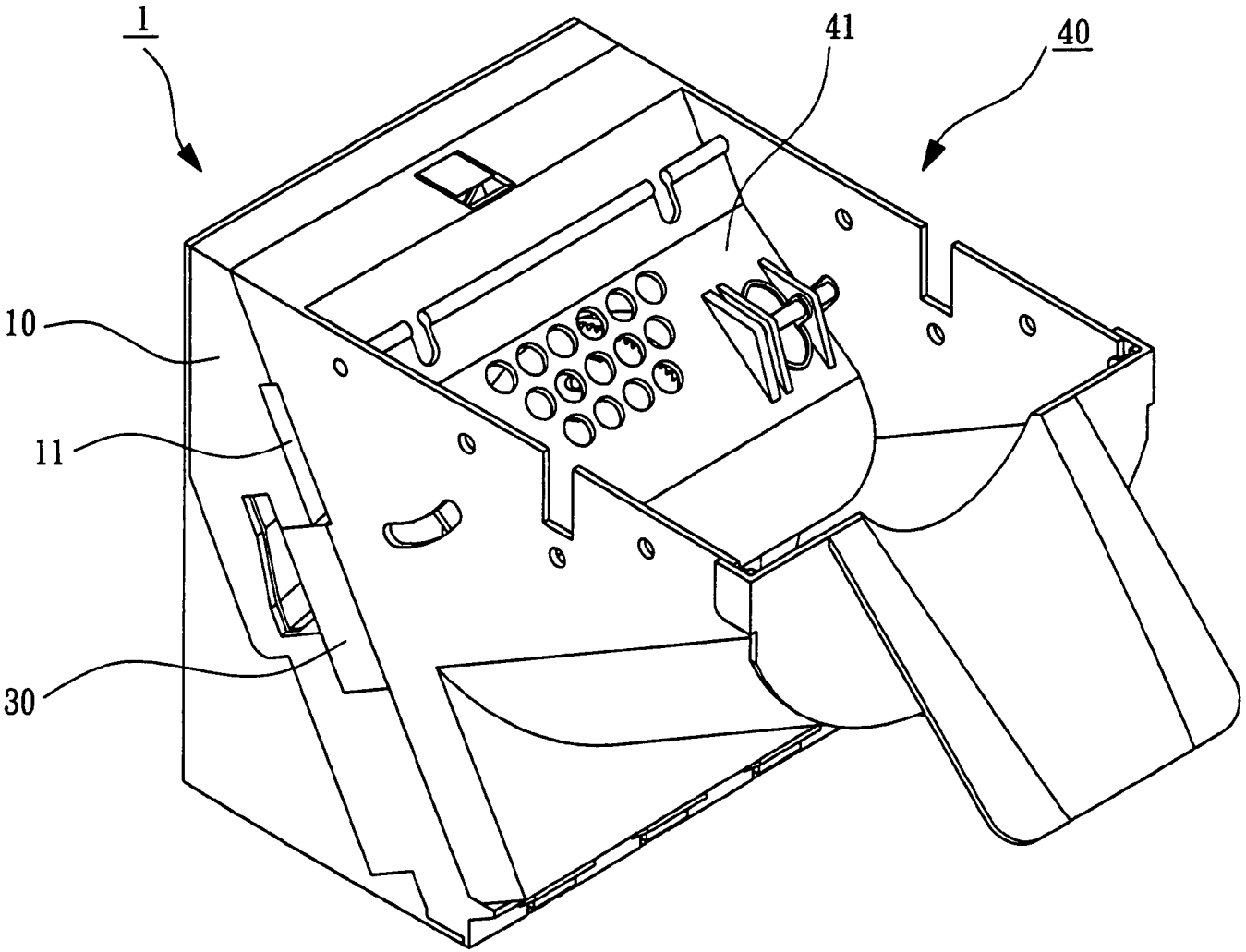
FIG. 6 is a perspective view of the complete carrying disk device of coin dispenser connecting a coin-collecting hopper in accordance with the present invention.

Furthermore, the carrying disk device of coin dispenser 1 of the present invention may be further provided many kinds of apparatus for improving coin-agitating and coin-turning motions. Referring to FIG. 6, the carrying disk device of coin dispenser 1 of the present invention further comprises a coin-collecting hopper 40 disposed on the machine frame 10. The coin-collecting hopper 40 has a coin-agitating board 41 to contact the inclined surface 28 of the coin-agitating controller 27 of the carrying disk 20, thereby makes the coin-agitating board 41 swing following the rotating carrying disk 20 for preventing the coins 2 collected in the coin-collecting hopper 40 from heaping in partial empty resulting in a false appearance. Entirely, the carrying disk device of coin dispenser 1 may reach excellent efficiencies of coin-agitating and coin-turning because of the stirring rods 29 on the cone 25, the coin-sliding trails 24 and the coin-sliding inclined lateral 33 of the guide arm 30 well applied with the carrying disk 20.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A carrying disk device of a coin dispenser comprising:

a machine frame having an outlet;

a carrying disk rotatively connected with the machine frame, the carrying disk having a coin-carrying surface and a plurality of posts arranged in a plurality of radial rows, the costs being fixed on and protruding from the coin-carrying surface, the carrying disk having a plurality of coin-holding spaces being formed between the plurality of rows of the posts on the coin-carrying surface; and a guide arm connected with the machine frame, the guide arm being adjacent to the outlet and covering a portion of the coin-carrying surface of the carrying disk, the guide arm having a bottom, a lateral guide and a plurality of curvilinear grooves at the bottom, the curvilinear grooves extending to the lateral guide for passing each row of the posts when the carrying disk is rotating, wherein the carrying disk has a plurality of coin-sliding trails on the coin-carrying surface which contact the posts in a direction so as to slide a coin out of the coin-holding spaces.

2. A carrying disk device of coin dispenser comprising:

a machine frame having an outlet;

a carrying disk rotatively connected with the machine frame, the carrying disk having a coin-carrying surface and a plurality of posts arranged in a plurality of radial rows, the posts being fixed on and carrying disk protruding from the coin-carrying surface, the carrying disk having a plurality of coin-holding spaces being formed between the plurality of cows of the posts on the coin-carrying surface; and a guide arm connected with the machine frame, the guide arm being adjacent to the outlet and covering a portion of the coin-carrying surface of the carrying disk, the guide arm having a bottom, a lateral guide and a plurality of curvilinear grooves at the bottom, the curvilinear grooves extending to the lateral guide for passing each row of the posts when the carrying disks rotating, further comprising a coin-collecting holder disposed on the machine frame, further comprising a coin-agitating board disposed in the coin-collecting hopper, the carrying disk has a coin-agitating controller having an inclined surface, the coin-agitating board contacting the inclined surface of the coin-agitating controller to swing when the carrying disk is rotated.

* * * * *